US009743788B1

(12) United States Patent
Wilson

(10) Patent No.: US 9,743,788 B1
(45) Date of Patent: Aug. 29, 2017

(54) SUPPORT APPARATUS FOR STICK AND BAGGED ITEMS

(71) Applicant: Kerry Wilson, Webster, TX (US)

(72) Inventor: Kerry Wilson, Webster, TX (US)

( * ) Notice: Subject to any disclaimer, the term of this patent is extended or adjusted under 35 U.S.C. 154(b) by 0 days.

(21) Appl. No.: 15/369,250

(22) Filed: Dec. 5, 2016

Related U.S. Application Data

(63) Continuation-in-part of application No. 14/206,994, filed on Mar. 12, 2014.

(51) Int. Cl.
*A47G 29/00* (2006.01)

(52) U.S. Cl.
CPC ..... *A47G 29/00* (2013.01)

(58) Field of Classification Search
CPC ..... A23G 7/0031; A47F 5/01; A01K 87/10
USPC ..... 211/60.1, 69.1, 69.8, 85.31, 120, 133.2, 211/181.1, 70.8; 47/41.13; D22/147; D28/38; D11/147
See application file for complete search history.

(56) References Cited

U.S. PATENT DOCUMENTS 643,266 A * 2/1900 Griggs ..... A47F 7/06 206/9
1,093,337 A * 4/1914 Kishler ..... A47J 29/06 211/181.1
1,860,405 A * 5/1932 Cheesewright ..... A01G 9/12 47/41.13
1,892,393 A * 12/1932 Halm ..... A01G 5/04 47/41.13
D97,712 S * 12/1935 Orben ..... 47/41.13
2,029,643 A * 2/1936 Sinclair ..... A47G 7/07 47/41.13
2,040,649 A * 5/1936 Fortes ..... A47J 29/06 211/181.1
D106,536 S * 10/1937 Heim ..... D19/84
2,520,818 A * 8/1950 Terry ..... A45F 3/44 248/153
2,601,743 A * 7/1952 Karsted ..... A01G 5/00 47/41.13
D188,384 S * 7/1960 Messer ..... 47/41.01
3,087,280 A * 4/1963 Seliger ..... A47G 7/07 47/41.13
3,586,274 A * 6/1971 Hart ..... A01K 97/10 248/156
4,331,721 A * 5/1982 Ayers ..... A01G 5/04 156/61
D286,591 S * 11/1986 Russell ..... D6/682.2
4,694,603 A * 9/1987 Anderson ..... A01K 97/10 43/21.2
D308,802 S * 6/1990 Ward ..... 248/156
5,294,083 A * 3/1994 Roth ..... E04H 15/003 248/146
5,402,899 A * 4/1995 Ammeson ..... A47G 23/0241 215/391

(Continued)

*Primary Examiner* — Joshua Rodden
(74) *Attorney, Agent, or Firm* — Eldredge Law Firm; Richard G. Eldredge

(57) ABSTRACT

What is provided is an apparatus for use in a decorative or edible arrangement, including a multiplicity of stem portions each having an upper end and a lower end, and holders each attached to the appropriate stem. Some holders comprise of spirally shaped receptacle mounted to the appropriate stems. The spirally shaped receptacle includes multiple coils surrounding a cavity. The coils have a hook attached at the end furthest from the elongated stem. The coils hold decorative or edible articles.

5 Claims, 3 Drawing Sheets

(56) References Cited

U.S. PATENT DOCUMENTS

| | | | | | |
|---|---|---|---|---|---|
| 5,570,863 | A | * | 11/1996 | Cooper | A47G 23/0225 248/146 |
| D377,695 | S | * | 1/1997 | Puckett | D28/38 |
| D416,071 | S | * | 11/1999 | Sizer | D19/84 |
| D416,976 | S | * | 11/1999 | Sizer | D22/147 |
| D419,330 | S | * | 1/2000 | Bjornbraten | D6/403 |
| 6,250,912 | B1 | * | 6/2001 | Widdowson | F23D 3/24 248/312.1 |
| 6,389,744 | B1 | * | 5/2002 | Pugh | A01G 9/12 211/181.1 |
| D489,118 | S | * | 4/2004 | Preiss | D22/147 |
| 7,387,283 | B2 | * | 6/2008 | Franczyk | A47F 5/04 211/181.1 |
| D618,074 | S | * | 6/2010 | Paetsch | D7/701 |
| 8,322,666 | B2 | * | 12/2012 | Duemmel | A45B 11/00 248/163.1 |
| D691,697 | S | * | 10/2013 | Purser | D22/147 |
| D703,369 | S | * | 4/2014 | Jones | D26/114 |

* cited by examiner

SUPPORT APPARATUS FOR STICK AND BAGGED ITEMS

1. FIELD OF THE INVENTION

This invention relates to a device for use in decorative and/or edible arrangements. More particularly, the present invention relates to a device to be used in confectionery arrangements.

2. BACKGROUND OF THE INVENTION

Creative flexibility is critical in the design and presentation of decorative and edible arrangements. Millions of dollars are spent each year on sending arrangements to friends, colleagues, loved ones, and business contacts. At the present time, decorative items, including food items such as cake pops or cookies on a stick, are presented in arrangements with the stick penetrated into a base such as wood or acrylic with pre-drilled holes, Styrofoam, or floral foam, limiting the height placement and design potential of the arrangement or display. Other preformed support structures prevent a user from designing an arrangement in different shapes. In addition to limiting the creative flexibility of the arrangement, the item, such as a cake pop or cookie, can become broken or damaged upon removal. Accordingly, what is needed is an apparatus that allows for maximum creative flexibility while preventing damage during the removal of the pieces of the arrangement.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

3. SUMMARY OF INVENTION

The apparatus of the present invention solves the problems confronted in the art in a simple and straightforward manner. What is provided is an apparatus for use in an arrangement, comprising a stem portion having an upper end and a lower end, and a holder attached to the upper end of the stem portion. What is further provided is apparatus for use in an arrangement, comprising a stem portion having an upper end and a lower end, and a plurality of holders attached to the upper end of the stem portion.

4. BRIEF DESCRIPTION OF THE DRAWINGS

The teachings of the present invention can be readily understood by considering the following detailed description in conjunction with the accompanying drawings, in which.

To facilitate understanding, identical reference numerals have been used where possible, to designate identical elements that are common to the figures.

5. DETAILED DESCRIPTION OF THE INVENTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
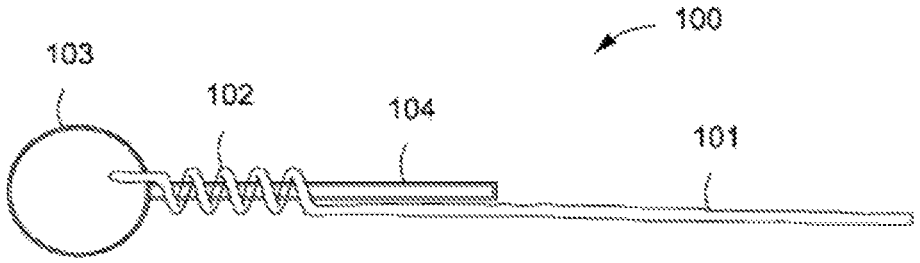
FIG. 1 illustrates a front view of a support apparatus for stick and bagged items.

FIG. 1 is a front view of a support apparatus for stick and bagged items 100 in accordance with certain aspects of the present disclosure. FIG. 1 shows a stem 101 having a holder 102 attached to an upper end of the stem. The stem may be made from a malleable material, such as wire, or a rigid material, such as plastic, for example. In the preferred embodiment, the holder 102 may be a corkscrew formed from the stem 101 for example. In alternative embodiments, the holder 102 may be any hollow cylindrical apparatus configured to receive a stick. FIG. 1 further shows a stick 104 with an edible portion 103 attached to an upper end of the stick. The stick 104 is inserted into an inner cavity of the holder 102. In the preferred embodiment, the edible portion 103 may be a cookie or a cake pop. The support apparatus 100 provides multiple advantages over prior art. First, the holder portion 102 provides for easy insertion or removal of a stick item. Inserting the stick 104 directly into a base causes friction and may lead to breaking the edible portion 103. Additionally, the stem 101 may be bent to allow for design flexibility when it is made of a malleable material. A lower end of the stem 101 may be inserted into a base, such as foam, for example, as part of a decorative or edible arrangement.

Figure 2:
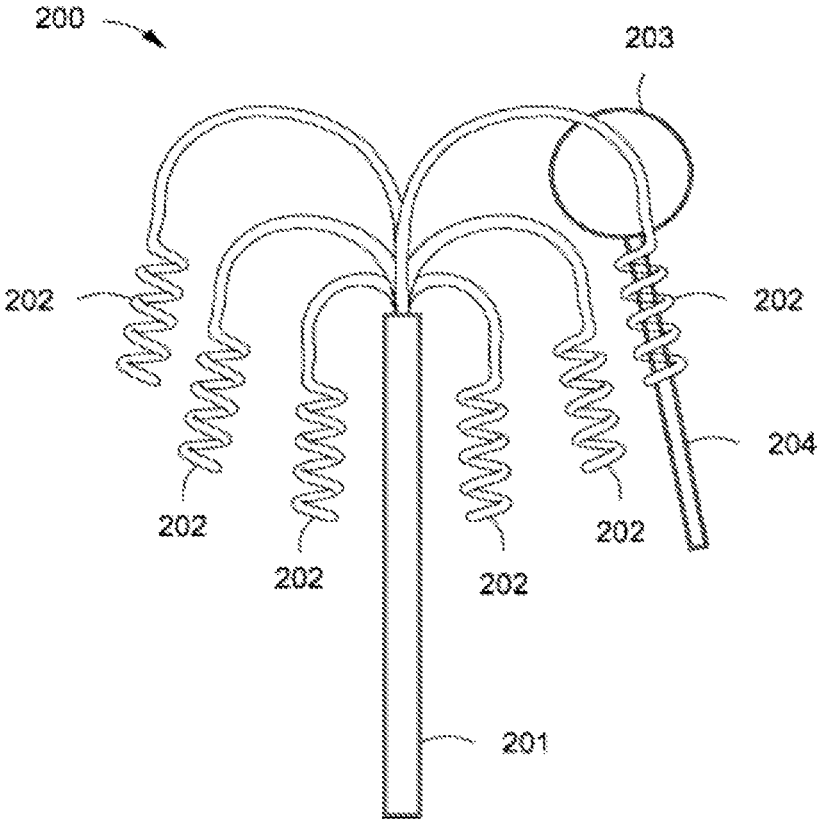
FIG. 2 illustrates a front view of a support apparatus with multiple holders for stick and bagged items.

FIG. 2 is a front view of a support apparatus for multiple stick and bagged items 200 in accordance with certain aspects of the present disclosure. FIG. 2 shows a stem 201 with a plurality of holders 202 attached to an upper end of the stem. In the preferred embodiment, the holders 202 may be corkscrews formed from the stem 201, for example. The stem 201 may be made from a multiple twisted elements, for example. In certain embodiments, the stem 201 and holders 202 may be made from a malleable material, for example, allowing flexibility of the holders. A user may bend the holders 202 in a y direction, such as a downward direction as shown in FIG. 2. FIG. 2 further shows an edible portion 203 attached to a stick 204. The stick 204 is inserted into an inner cavity of the holder 202. The embodiment shown in FIG. 2 provides several advantages over the prior art. First, only a single stem 201 needs to be inserted into a base. This configuration also allows a user to make designs intended for a vase. Additionally, a user may selectively bend one or more of the holders 202 into an aesthetically pleasing configuration.

Figure 3:
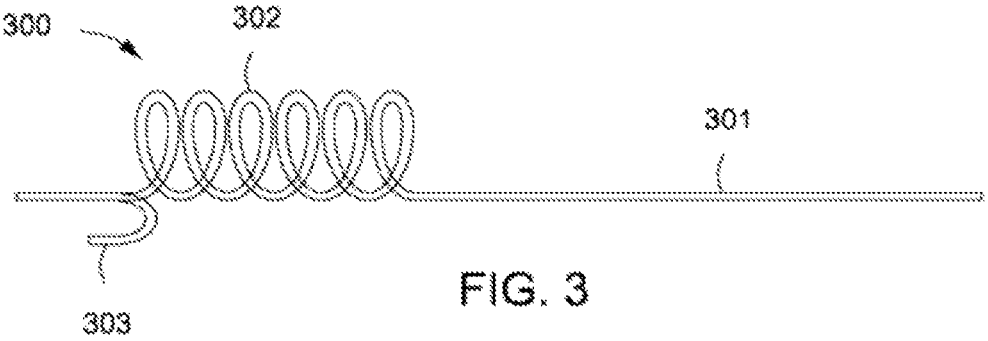
FIG. 3 illustrates a front view of a support apparatus with a hook for stick and bagged items.

FIG. 3 is a front view of a support apparatus for multiple stick and bagged items 300 in accordance with certain aspects of the present disclosure. FIG. 3 shows a stem 301 having a holder 302 attached to an upper end of the stem. A support element 303 is attached to an upper end of the holder 302. The support element 303 is configured to support bagged items that may not necessarily have sticks. While the support 303 is shown as a hook in FIG. 3, a person with ordinary skill will appreciate that other mechanisms, such as clips and pins, for example, may be used in alternative embodiments. In certain embodiments, the holder 302 may be used to support small bottles, such as a miniature alcohol bottles.

Figure 4:
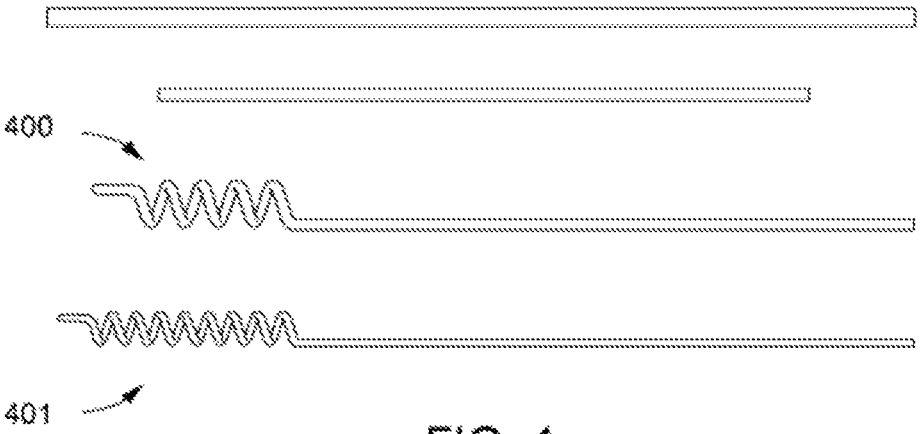
FIG. 4 illustrates a front view of two support apparatuses with different stem widths.

FIG. 4 is a front view of two support apparatuses for multiple stick and bagged items in accordance with certain aspects of the present disclosure. Support apparatus 400 is shown with a relatively thick diameter. Support apparatus 401 is shown with a relatively thin diameter. Items included in decorative and edible arrangements have varying weights and often are seated atop sticks with varying diameters. Support apparatuses may bend and twist under the weight of a sick or bagged item. An increased diameter provides a more sturdy support apparatus for a heavier item. Further, a user may want to coat the stem of a support apparatus with a product that will increase friction between the stem and the base to prevent undesired movement. Rubber and powder coatings may be appropriate, for example.

Figure 5:
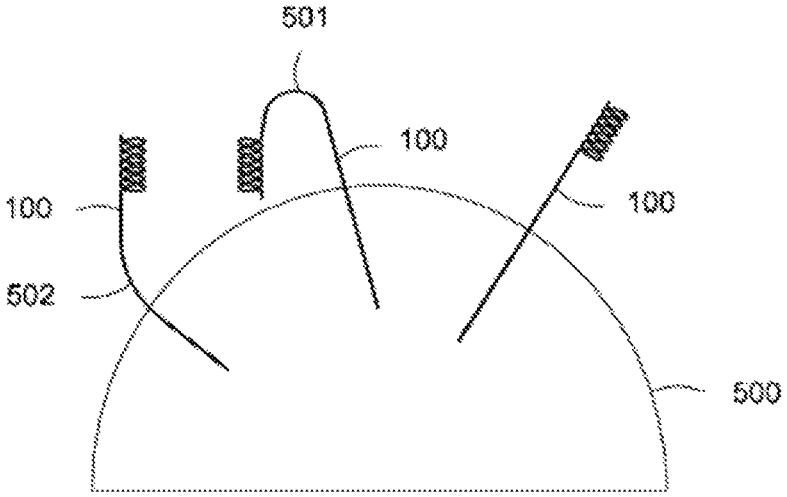
FIG. 5 illustrates a front view of multiple support apparatuses inserted into a base.

FIG. 5 is a front view of a plurality of support apparatuses for multiple stick and bagged items 100 inserted into a base 500 in accordance with certain aspects of the present disclosure. FIG. 5 shows support apparatuses 100 inserted into varying locations on base 500. A user may select where to insert the support apparatus 100 into the base 500, providing an increased amount of design flexibility. FIG. 5 further shows bends 501 and 502, which allows the user to choose the direction that a stick or bagged item will point.

Figure 6:
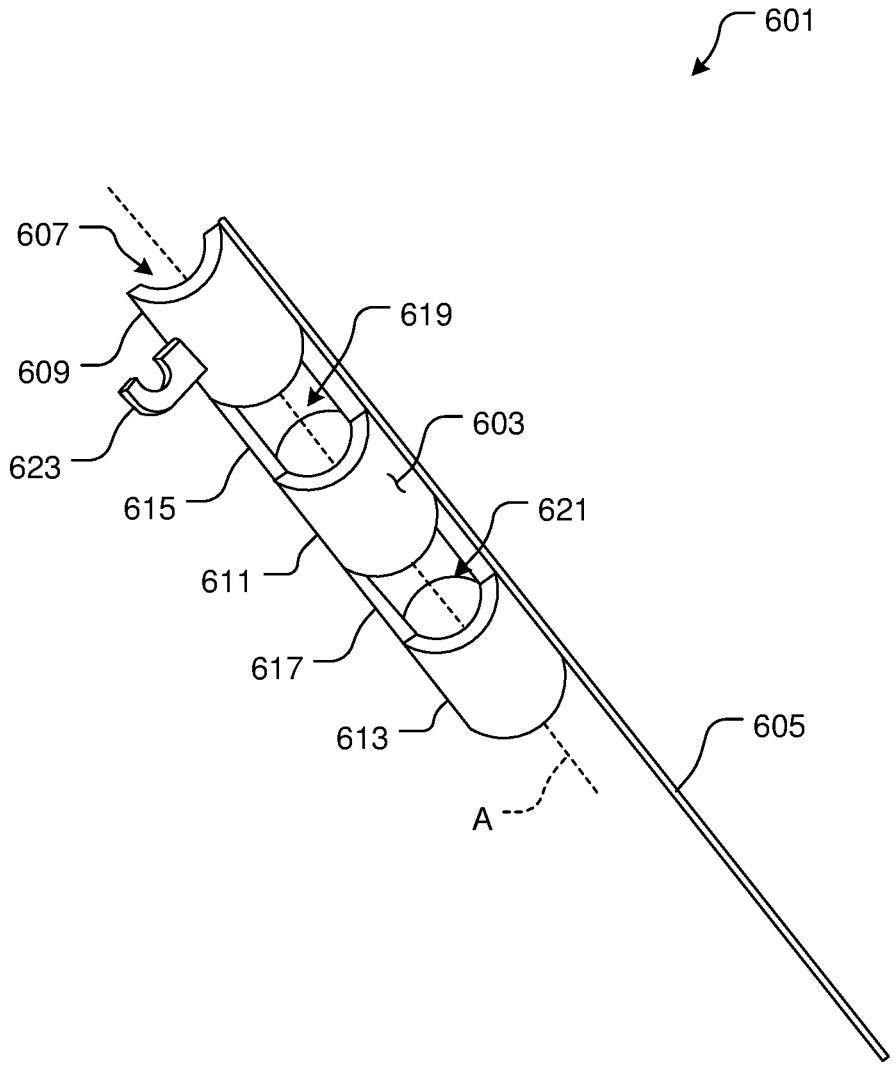
FIG. 6 is an oblique view of a system in accordance with an alternative embodiment of the present invention.

FIG. 6 is an oblique view of a support system in accordance with an alternative embodiment of the present invention. It will be appreciated that system 601 includes one or more of the features discussed above and incorporates the same. The system 601 shares the same functionality of the above structures and is provided with a body 603 secured to an elongated shaft 605. The body 603 forms a central opening 607 configured to receive an item therein and extends along a center axis "A" as indicated by a dashed line.

The body 603 comprises of one or more front semi-circular contoured sections 609, 611, and 613 rigidly and integrally attached to back semi-circular contoured sections 615 and 617.

The body forms an opening 619 positioned between sections 609, 611 and a second opening 621 between sections 611, 613. Although not shown, the opposing side of body 603 creates an additional 3 openings. It will be appreciated that the openings provide effective means for a finger and/or other object to reach the center opening 607 extending along the length of body 603.

The system 601 is further contemplated having a hook 623 rigidly attached to section 609 and configured to secure an object thereto. One of the unique features believed characteristic of the present embodiment is that the components of system 601 are integrally attached to each other, which in turn allows the system to be manufactured via an injection molding process. However, other manufacturing process are also contemplated.

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. An apparatus for use in an arrangement of selective decorative or edible articles, comprising:

a first stem portion having an upper end portion and a lower end portion;

a first body rigidly and integrally attached to the upper end portion of the first stem portion;

a first front semi-circular contoured section;

a second front semi-circular contoured section;

a third front semi-circular contoured section;

a first back semi-circular contoured section;

a second back semi-circular contoured section;

a central opening extending through a center axis of the body, and configured to receive an item therein;

a first opening extending from outside the body and into the center opening, the first opening positioned between the first front semi-circular contoured section and the second front semicircular contoured section;

a second opening extending from outside the body and into the center opening, the second opening positioned between the second from semi-circular contoured section and the third semi-circular contoured section; and a hook attached to the first front semi-circular contoured section, said hook extending out laterally away from the first front semi-circular contoured section and having a concave portion positioning an end of the hook away from the first semi-circular contoured section and facing in a same direction as the upper end portion of the first stem;

wherein the first, second, and third front semi-circular contoured sections are rigidly and integrally attached to the first and second back semi-circular contoured sections;

a second stem having an upper end portion and a lower end portion;

a second body rigidly and integrally attached to the upper end portion of the second stem;

an elongated member having a hollow center configured to receive and securely hold the lower end portion of the first stem and the lower end portion of the second stem in the hollow center;

wherein the elongated member is configured to secure into a base forming the arrangement of selective decorative or edible articles.

2. The apparatus of claim 1, wherein the central opening is configured to hold a stick item.

3. The apparatus of claim 1, wherein the first stem is made from a malleable material.

4. The apparatus of claim 1, wherein the first stem is made from a rigid material.

5. The apparatus of claim 1, wherein the first stem is coated.

* * * * *